US007762190B1

(12) United States Patent
Laib et al.

(10) Patent No.: US 7,762,190 B1
(45) Date of Patent: Jul. 27, 2010

(54) MEMS MECHANICAL INITIATOR FOR A MICRODETONATOR

(75) Inventors: Gerald Laib, Olney, MD (US); Daniel Jean, Odenton, MD (US); David Olson, Chesapeake Beach, MD (US); Michael Beggans, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/894,630

(22) Filed: Jul. 31, 2007

(51) Int. Cl.
*C06C 9/00* (2006.01)

(52) U.S. Cl. ..... 102/205; 102/221; 102/226; 102/230; 102/233; 102/242; 102/249; 102/255; 102/256; 102/274

(58) Field of Classification Search ..... None
See application file for complete search history.

(56) References Cited

U.S. PATENT DOCUMENTS 5,806,152 A * 9/1998 Saitou et al. ..... 24/662
6,167,809 B1 * 1/2001 Robinson et al. ..... 102/235
6,173,650 B1 1/2001 Garvick et al.
6,431,594 B1 8/2002 Swann et al.
6,584,911 B2 7/2003 Bergerson et al.
6,640,719 B1 11/2003 Pacella et al.
6,964,231 B1 11/2005 Robinson et al.
6,986,307 B2 1/2006 Bernhard et al.
7,040,234 B1 * 5/2006 Maurer et al. ..... 102/226
2006/0070547 A1 4/2006 Combes et al.

* cited by examiner

*Primary Examiner*—Troy Chambers
*Assistant Examiner*—Samir Abdosh
(74) *Attorney, Agent, or Firm*—Fredric J. Zimmerman

(57) ABSTRACT

A MEMS mechanical initiator having a striker arm extending from a striker body. The tip of the striker arm is adjacent to, but does not touch, the side of a microdetonator. A cocking and release mechanism moves the striker body such that the striker arm pulls away from the side of the microdetonator against the action of a set of springs connected to the striker body. Thereafter the cocking and release mechanism releases the striker body such that the tip of the striker arm swipes the side of the microdetonator causing initiation thereof.

8 Claims, 4 Drawing Sheets

MEMS MECHANICAL INITIATOR FOR A MICRODETONATOR

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1) Field of the Invention

The invention in general relates to MEMS (microelectromechanical systems) fuzes, and more particularly to a device for initiating a microdetonator in such fuze 2) Description of the Related Art A MEMS fuze uses a tiny microdetonator to initiate a charge sequence to detonate an explosive such as a munitions charge. A conventional method for mechanical initiation of conventional detonators typically uses stab pins. These stab pins however, are much too large to integrate into a microdetonator fuze.

SUMMARY OF THE INVENTION

It is an object of the invention to provide a mechanical initiator that is small enough to initiate a microdetonator.

A MEMS mechanical initiator apparatus includes a microdetonator having a side. The apparatus includes a striker body having a striker arm extending therefrom. A tip of the striker arm is adjacent the side of the microdetonator prior to initiation. A set of anchored springs is connected to the striker body. A cocking and release mechanism is initially operable to withdraw the striker body such that the striker arm moves away from the side of the microdetonator against action of the springs. The cocking and release mechanism is thereafter operable to release the striker body such that the striker arm will be propelled by the springs to swipe the side of the microdetonator to cause detonation thereof by heat generated from viscoplastic deformation.

BRIEF DESCRIPTION OF THE DRAWINGS

In the drawings, which are not necessarily to scale, like or corresponding parts are denoted by like or corresponding reference numerals.

DETAILED DESCRIPTION OF EXEMPLARY EMBODIMENTS OF THE INVENTION

Figure 1A:
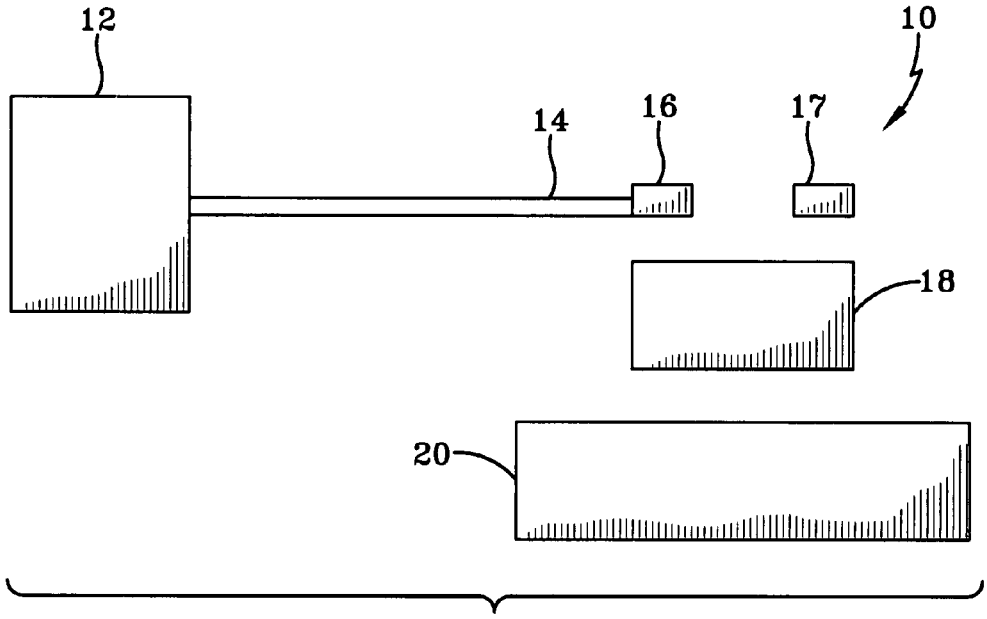
FIGS. 1A and 1B illustrate the placement sequence for using a microdetonator.
Figure 1B:
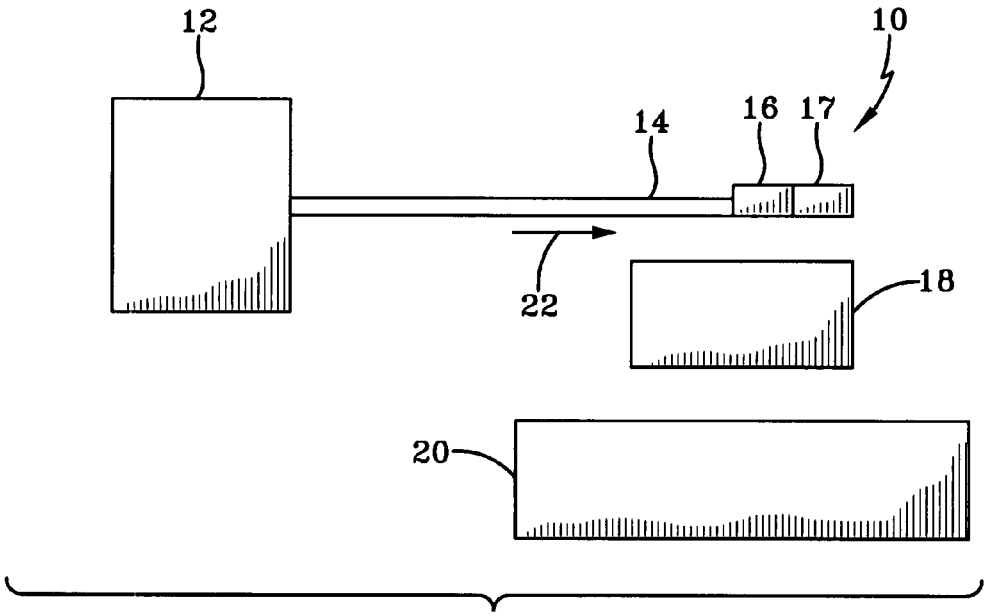

FIGS. 1A and 1B illustrate a microdetonator and its placement for initiating a charge sequence. A driver 12 is operative to move a slider element 14 carrying a microdetonator 16 to put it in proper position adjacent a mechanical initiator 17, the subject of the present invention. The microdetonator 16 is used to set off a secondary explosive in the form of secondary lead 18, which will set off the main charge 20, forming a portion of a munition round, by way of example.

In FIG. 1A, the microdetonator 16 is in an initial position insufficient to set off the secondary explosive 18. When the driver 12 is engaged, as indicated in FIG. 1B, it will move slider 14 in the direction of arrow 22 until the microdetonator 16 is adjacent the mechanical initiator 17 and directly above explosive lead 18, whereupon the entire detonation process may proceed.

Figure 2:
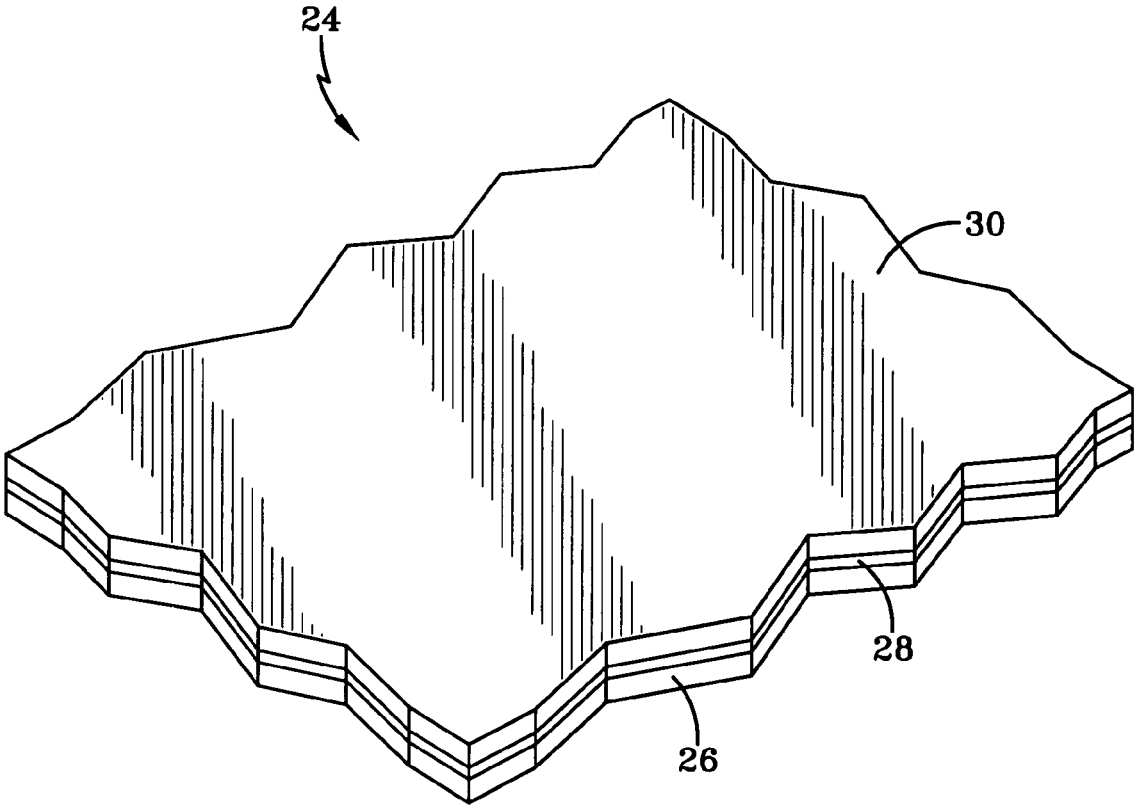
FIG. 2 illustrates an SOI (silicon on insulator) wafer prior to fabrication of the MEMS device of the present invention.

FIG. 2 illustrates a portion of an SOI wafer 24 from which a mechanical initiator apparatus 32 of the present invention will be fabricated. The structure of FIG. 2 includes a silicon substrate 26 (also known as a handle layer) covered by an insulating, or intermediate layer 28, such as silicon dioxide, over which is bonded or deposited another silicon layer 30, also known as the device layer, which is the layer from which the mechanical initiator components are fabricated.

The mechanical initiator components are formed by a DRIE (deep reactive ion etching) process that removes unwanted portions of device layer 30. The DRIE process is a well-developed micromachining process used extensively with silicon based MEMS devices. For this reason silicon is an exemplary material for the mechanical initiator apparatus 32 of the present invention, although other materials are possible.

Figure 3A:
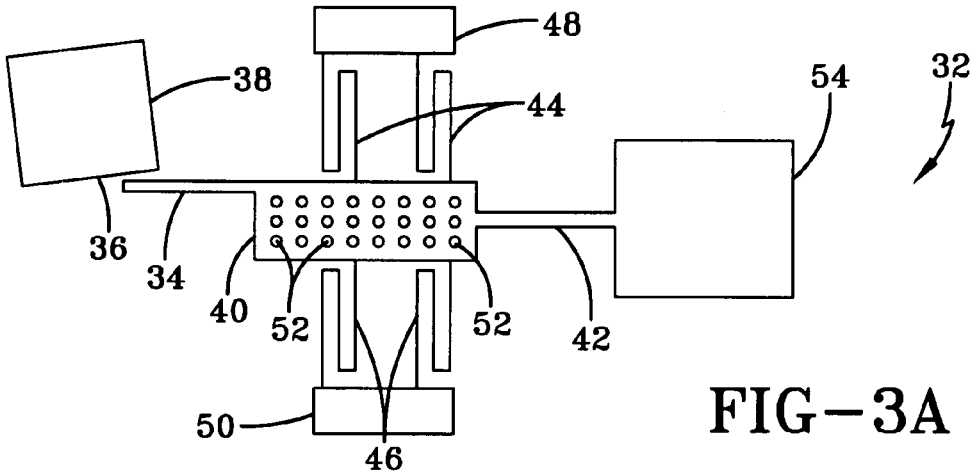
FIGS. 3A to 3C illustrate one embodiment of the present invention.

The mechanical initiator apparatus 32 of FIG. 3A includes a striker arm 34, the end of which is at a slight angle to, and adjacent, but not touching, a side 36 of a microdetonator 38. Striker arm 34 extends from striker body 40 at one side thereof while a trigger arm 42 extends from an opposite side. Striker body 40 is connected to spring sets 44 and 46, which, in turn are connected to respective anchors 48 and 50.

To operate as a MEMS mechanical initiator, the arms 34 and 42, as well as striker body 40 and spring sets 44 and 46 must be free to move and therefore must be free of any underlying silicon dioxide insulating layer 28 (FIG. 2). One way to accomplish the removal of the underlying insulating layer is by applying an etchant such as hydrofluoric acid that will dissolve the silicon dioxide. The etchant will, in a relatively short period of time, dissolve the insulation beneath the arms 34 and 42 as well as spring sets 44 and 46, as they are of small width, thus freeing them for movement. To shorten the time for dissolving the silicon dioxide under the striker body 40, the stricker body 40 may be provided with a series of apertures 52, which extend from the top surface down to the insulating layer 28, thereby allowing the etchant direct access to the undersurface of the striker body 40. Although some of the etchant dissolves the insulation under the anchors 48 and 50, the process of freeing the other components is completed before the anchors are completely freed so that they remain immovable.

The mechanical initiator apparatus 32 additionally includes a cocking and release mechanism 54 connected to trigger arm 42. The cocking and release mechanism 54 may be either be electrically actuated or environmentally actuated. An example of environmental actuation is the use of gun launch acceleration for cocking and target impact deceleration for release.

Figure 3B:
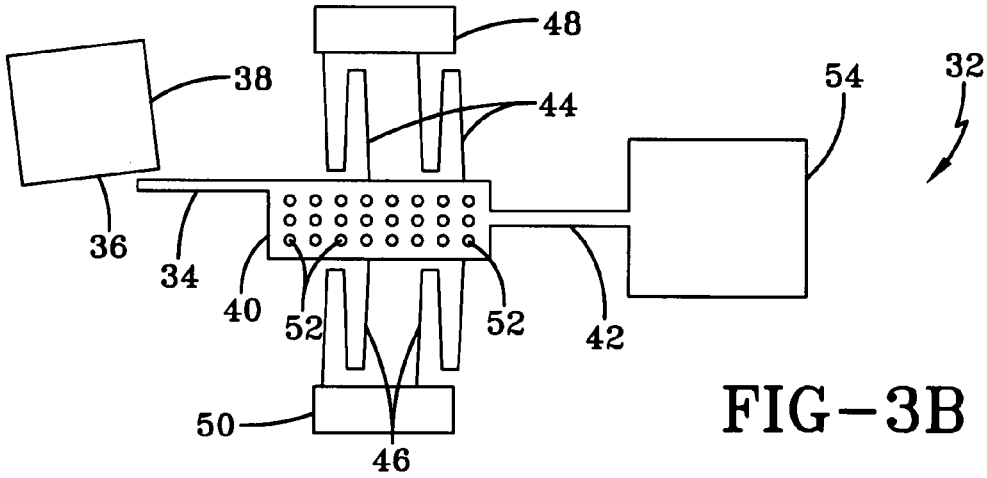

When activated, and as illustrated in FIG. 3B, the cocking and release mechanism 54 causes trigger arm 42 to be withdrawn against the action of springs 44 and 46, and along with it, the strikerbody 40 and striker arm 34. When trigger arm 42 is released by cocking and release mechanism 54, as indicated in FIG. 3C, under action of springs 44 and 46, the tip of striker arm 34 will swipe the side 36 of microdetonator 38 whereby the microdetonator 38 is initiated by heat generated from viscoplastic deformation.

Figure 3C:
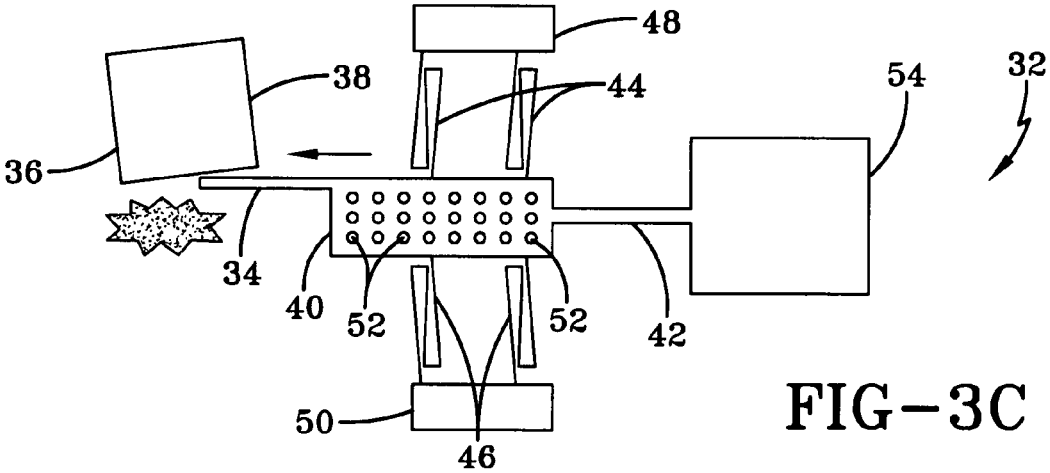
Figure 4A:
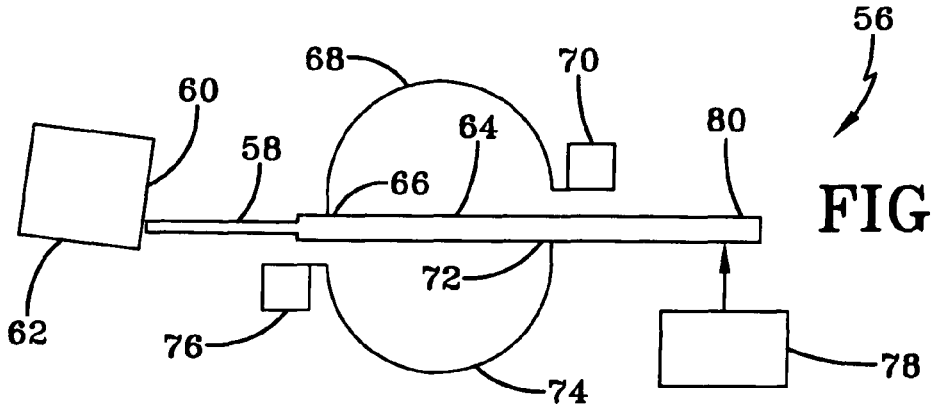
FIGS. 4A to 4C illustrates another embodiment.
Figure 4B:
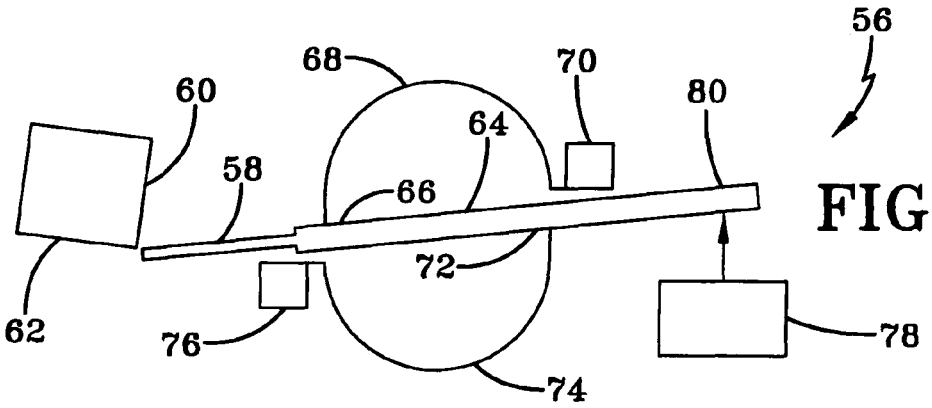
Figure 4C:
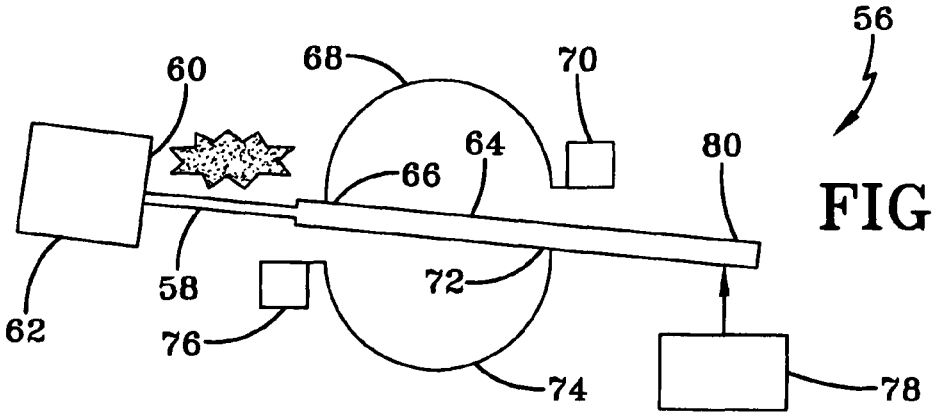

In the embodiment of FIGS. 3A to 3C, microdetonator initiation is achieved by linear movement of striker arm 34. In the embodiment of FIGS. 4A to 4C, initiation is achieved by rotational movement of a striker arm.

The mechanical initiator 56 in FIG. 4A includes a striker arm 58, the end of which is at a slight angle to, and adjacent, but not touching a side 60 of microdetonator 62. Striker arm 58 extends from a relatively thin striker body 64, a forward portion 66 of the thin striker body 64, which is connected to a curved spring 68 having its other end connected to an anchor 70. A more distal portion 72 of striker body 64 in relation to the striker arm 58 is connected to a second curved spring 74. The second curved spring 74 having its other end connected to anchor 76. Cocking and release mechanism 78 may be operative to act upon the distal end 80 of striker body 64 in a direction transverse thereto.

As seen in FIG. 4B, when cocking and release mechanism 78 operates to push on distal end 80, striker body 64 and striker arm 58 are rotated in a counterclockwise direction against the action of springs 68 and 74. This action withdraws the end of striker arm 58 from side 60 of microdetonator 62. When cocking and release mechanism 78 releases the distal end 80 of striker body 64, as illustrated in FIG. 4C, the striker body 64 and striker arm 58 are moved in a clockwise direction such that the tip of striker arm 58 will swipe the side 60 of microdetonator 62 whereby the microdetonator 62 is initiated by heat generated from viscoplastic deformation. It is evident that by reorienting the microdetonator 62, the clockwise and counterclockwise directions for initiation may be reversed from that described.

There has been described a mechanical initiator which is much smaller than conventional stab detonators and can be made to interface with a microdetonator. Further, the mechanical initiator may be fabricated using a MEMS process and can be directly incorporated into a MEMS fuze chip. It will be understood that many additional changes in the details, materials, steps and arrangement of parts, which have been herein described and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A MEMS mechanical initiator apparatus, comprising:

a microdetonator having a side;

a striker body including a striker arm extending therefrom;

a tip of said striker arm being adjacent said side of said microdetonator prior to initiation;

a set of anchored springs connected to said striker body; and a cocking and release mechanism connected to move said striker body, wherein said cocking and release mechanism being initially operable to withdraw said striker body such that said striker arm moves away from said side of said microdetonator against action of said springs, wherein said cocking and release mechanism is thereafter operable to release said striker body such that said striker arm is propelled by said springs to swipe said side of said microdetonator to cause detonation thereof, and wherein said striker arm is a mechanical striker arm capable of operation by movement where the mechanical striker arm and the microdetonator are situated on a same layer.

2. The apparatus according to claim 1, wherein said striker body moves in a linear direction during withdrawal and release.

3. The apparatus according to claim 2, wherein a first set of said anchored springs is connected to one side of said striker body and a second set of said anchored springs is connected to an opposite side of said striker body.

4. The apparatus according to claim 1, wherein said striker body moves in a rotational direction during withdrawal and release.

5. The apparatus according to claim 4, wherein said set of anchored springs includes a first anchored spring connected to said striker body at a forward portion thereof and a second anchored spring connected to said striker body at a more distal portion than said forward portion thereof, and wherein an arrangement of said set of anchored springs allows said striker body to rotate in a clockwise and counterclockwise direction.

6. The apparatus according to claim 4, wherein said cocking and release mechanism is operable to move a distal end of said striker body to rotate said striker body in a selected one of a counterclockwise direction and a clockwise direction, against the action of said springs, to move said tip away from said microdetonator, and wherein said cocking and release mechanism is thereafter operable to move said striker body in an opposite direction to cause said tip to swipe said side of said microdetonator.

7. The apparatus according to claim 1, wherein said cocking and release mechanism acts on said striker body at a distal end thereof in a direction transverse thereto.

8. The apparatus according to claim 1, wherein said striker body is configured to move in one of a linear direction and a rotational direction during withdrawal and release.

* * * * *